United States Patent [19]

Slagter

[11] Patent Number: 4,813,571

[45] Date of Patent: Mar. 21, 1989

[54] ADJUSTABLE LABEL DISPENSING DEVICE

[75] Inventor: Michael G. Slagter, Afton, Minn.

[73] Assignee: Minnesota Mining and Manufacturing Company, St. Paul, Minn.

[21] Appl. No.: 930,744

[22] Filed: Nov. 14, 1986

[51] Int. Cl.[4] ..... B65H 5/28

[52] U.S. Cl. ..... 221/13; 221/73; 156/DIG. 33

[58] Field of Search ..... 221/13, 71–73; 156/DIG. 33, DIG. 45

[56] References Cited

U.S. PATENT DOCUMENTS 3,568,881 3/1971 Croney ..... 221/13

3,814,651 6/1974 Tokiowada ..... 156/DIG. 33

*Primary Examiner*—F. J. Bartuska

*Attorney, Agent, or Firm*—Donald M. Sell; Leland D. Schultz

[57] ABSTRACT

A label dispensing device 10 that defines a path for a liner 14 carrying the labels 13 including an edge 18 defining an abrupt change in direction so that when the liner 14 is pulled around the edge 18 a label 13 will separate from the liner 14 and continue past the edge 18 to a position sensed by a sensor that stops the device 10 so that the label 13 may be manually removed for application to an object. A support member 26 having a distal portion 28 supporting the sensor is adjustable to position the sensor at various distances from the edge 18 to thus afford dispensing of various length labels 13. A guide member 30 between the distal portion 28 and a position adjacent the edge 18 has a surface adapted to afford sliding movement of the adhesive coated surface of the labels 13 along the guide member 30 to the sensor. The guide member 30 changes length as necessary upon movement of the support member 26 to its various positions.

5 Claims, 3 Drawing Sheets

ADJUSTABLE LABEL DISPENSING DEVICE

TECHNICAL FIELD

The present invention relates to label dispensing devices.

BACKGROUND ART

Devices are known for dispensing labels from label stock comprising a plurality of labels releasably adhered seriatim along a release liner. Typically such devices include a frame, means on the frame defining a path for the release liner including an edge defining an abrupt change in direction between first and second path portions, means including a drive motor adapted for tensioning the release liner around the edge and pulling the release liner around the edge from the first path portion to the second path portion so that labels on the release liner will separate from the liner and continue past the edge in the direction of the first path portion to a position at which the labels may be manually engaged and removed for application to an object, and means for sensing the leading end portion of the labels separated from the liner at the edge and for stopping operation of the motor when an end portion of the label is sensed.

Known devices of this type have adjustably positioned the means for sensing along a support member fixed relative to the frame, which support member can interfere with ease of removing the labels, particularly when relatively short labels are being dispensed. Also such devices have relied on the stiffness of the labels being dispensed to guide them to the sensing means, which restricts the type of label that can be reliably dispensed by the device.

DISCLOSURE OF INVENTION

The present invention provides an improved label dispensing device of the type described above which includes a support member having a distal portion supporting the means for sensing, which support member is adjustably mounted on the frame for movement to various positions with the distal portion carrying the means for sensing at various spacings from the edge so that the support member will not interfere with the removal of even short labels from the device. Also the improved label dispensing device according to the present invention includes a guide member between the distal portion and a position adjacent the edge at which the label separates from the liner, which guide member has a surface adapted to afford sliding movement of the adhesive coated surface of the labels along the guide member and helps to guide the labels to the means for sensing, and means are provided for varying the length of the guide member upon movement of the support member to its various positions.

Preferably the guide member has one end attached to the distal portion and comprises a flexible metal core coated with a material to provide its slippery surface, and the means for varying the length of the guide member includes a reel rotatably mounted on the frame withn end portion of the guide member opposite its end attached to the distal portion wrapped around the reel, a guide member on the frame guiding the guide member at the position adjacent the edge, and means biasing the reel for rotation in a direction to wind the guide member onto the reel.

The flexible metal core can be, for example, a metal strip, stranded cable or link chain, and the coating can be of any type not readily adhered to by the pressure sensitive adhesives used on labels, such as a thin film deposited from a plasma.

BRIEF DESCRIPTION OF THE DRAWING

The present invention will be further described with reference to the accompanying drawing wherein like reference numeral refer to like parts in the several views, and wherein.

DETAILED DESCRIPTION

Figure 1:
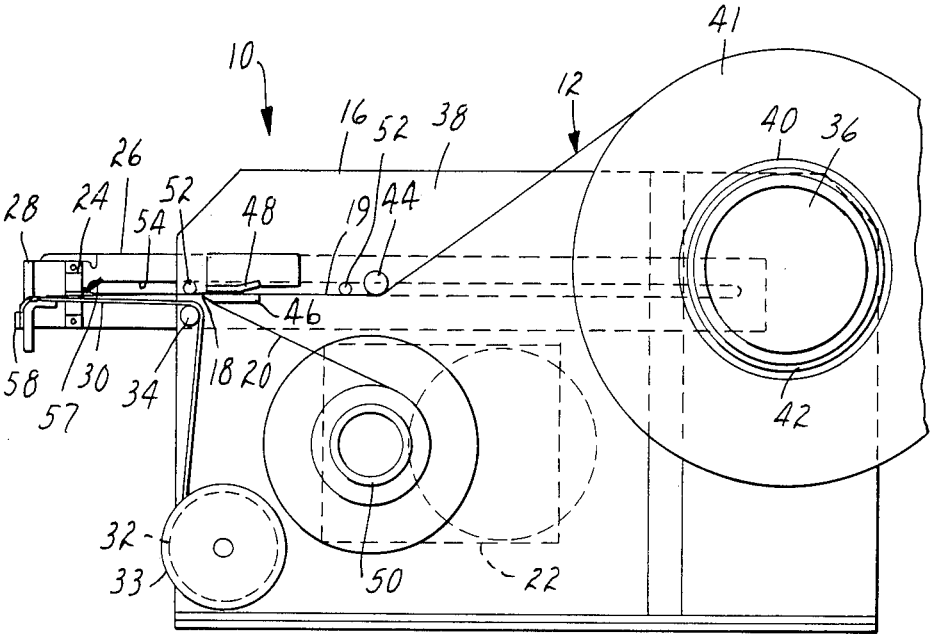
FIG. 1 is a side elevational view of a device for dispensing labels according to the present invention.
Figure 2:
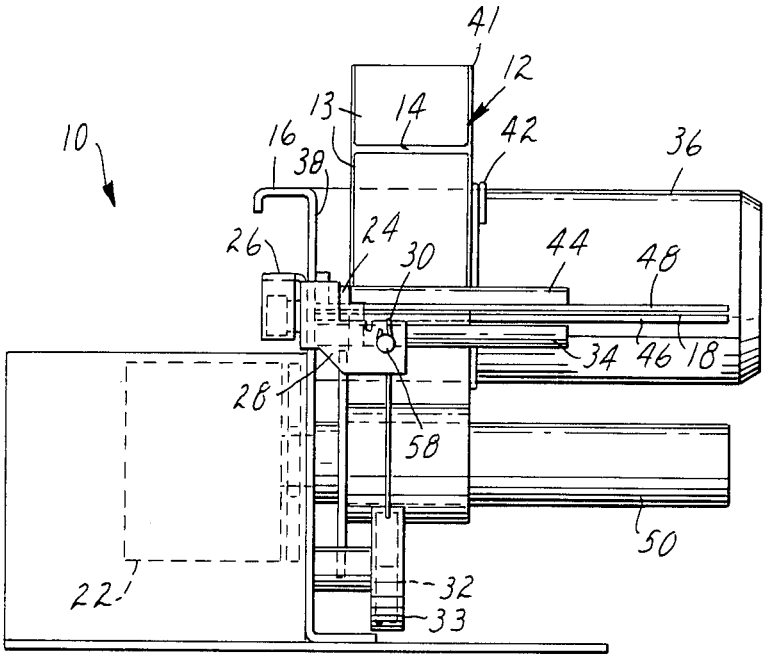
FIG. 2 is a front elevational view of the device of FIG. 1.

Referring now to the drawing there is shown a device for dispensing labels according to the present invention, generally designated by the reference numeral 10.

Figure 4:
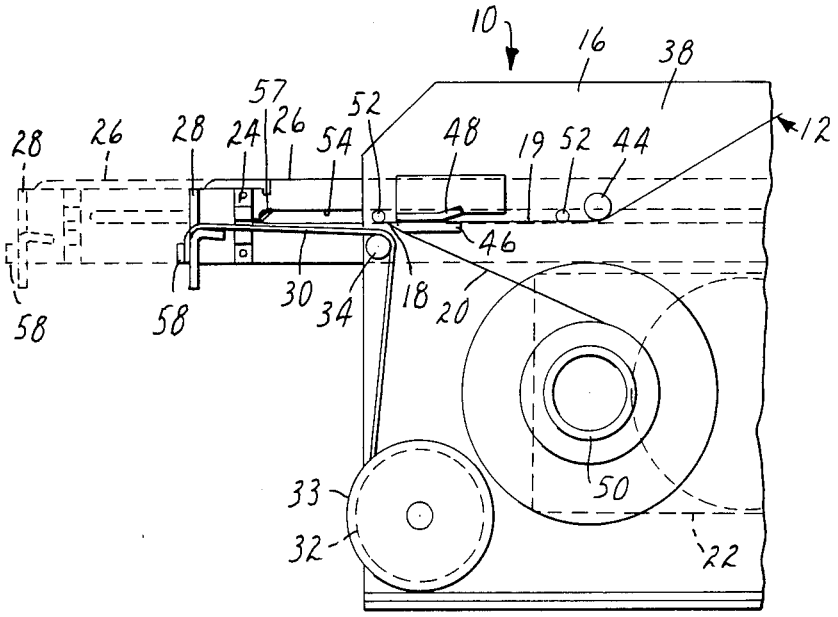
FIG. 4 is a fragmentary side elevational view of the device of FIG. 1 illustrating by dotted outline one alternate position of a support member included in the device.
Figure 5:
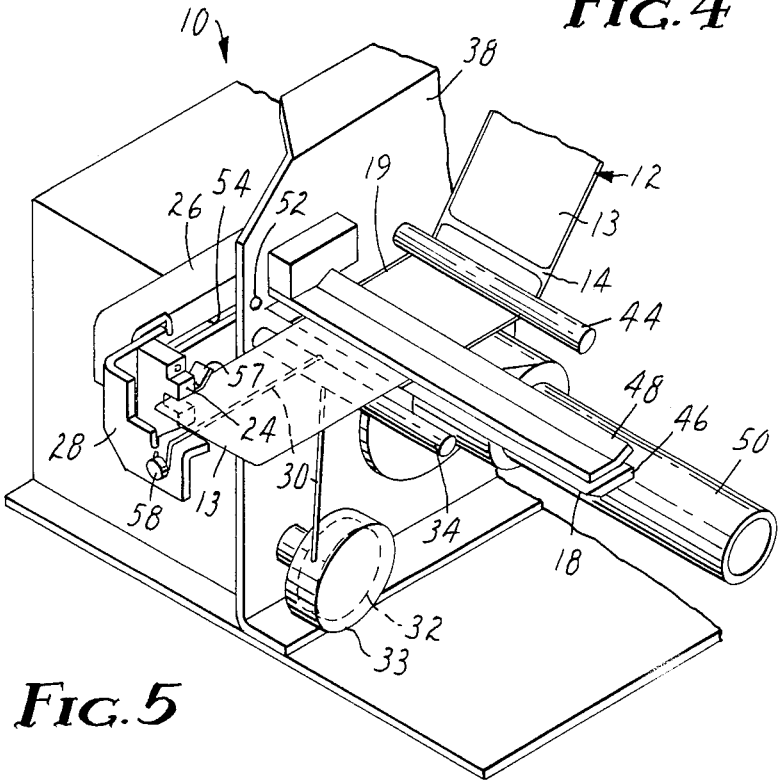
FIG. 5 is a fragmentary perspective view of the device of FIG. 1.

The device 10 is adapted for dispensing labels 13 from a strip material 12 comprising a plurality of labels 13 releasably adhered seriatim along a release liner 14, and is of the type including a frame 16, means on the frame 16 adapted for defining a path for the release liner 14 including an edge 18 defining an abrupt change in direction about the edge 18 (e.g., an acute included angle of about 30 degrees) between first and second to path portions 19 and 20, means including a drive motor 22 adapted for tensioning the release liner 14 around the edge 18 and pulling the release liner 14 around the edge 18 from the first path portion 19 to the second path portion 20 so that labels 13 on the release liner 14 will separate from the liner 14 and continue past the edge 18 in the direction of the first path portion 19 to a position at which a label 13 thus separated may be manually engaged and removed for manual application to an object, and means including a photosensor 24 for sensing the leading end portion of the labels 13 separated from the liner 14 at the edge 18 and for stopping operation of the motor 22 when the leading end portion of that label 13 is sensed. The improved device 10 includes a support member 26 having a distal portion 28 supporting the photosensor 24, which support member 26 is adjustably mounted on the frame 16 for movement to various positions (two of which are illustrated in FIG. 4, one in solid outline and the other in dotted outline) with the distal portion 28 at various spacings from the edge 18; and the device 10 also includes a guide member 30 between the distal portion 28 and a position adjacent the edge 18 having a surface adapted to afford sliding movement of the pressure sensitive adhesive coated surface of the labels 13 along the guide member 30 to guide the labels 13 to the photosensor 24, and means for varying the length of the guide member 30 upon movement of the support member 26 to its various positions.

The guide member 30 has one end attached to the distal portion 28 and comprises a flexible metal core (which as illustrated is a stranded metal cable, but which could alternatively be a spring metal strip or a length of chain) and a coating on the core (e.g., the thin film deposited from a plasma material sold and applied under the trade designation 915-T "Thermal Spray" by Plasma Coatings, Inc., Waterbury, Conn. 06702) to provide its slippery surface. The means for varying the length of the guide member 30 includes a reel 32 rotatably mounted on the frame 16 within a housing 33 with an end portion of the guide member 30 opposite its end attached to the support member 26 wrapped around the reel 32, a guide bar 34 fixed on the frame 16 guiding the guide member 30 at said position adjacent the edge 18, and means in the form of a coil spring (not shown) for biasing the reel 32 for rotation in a direction to wind the guide member 30 onto the reel 32.

The means on the frame 16 for defining the path for the release liner 14 includes a cylindrical hub 36 fixed to and horizontally projecting from a vertical side wall 38 of the frame 16, which hub 36 projects through and frictionally engages the inner surface of a core 40 around which is wrapped a coil 41 of the continuous liner 14 to which labels 13 are adhered. The core 40 and coil 41 are retained in place between the side wall 38 and a single coil spring 42 biased into engagement with the periphery of the hub 36. The first path portion 19 for the liner 14 extending from the coil 41 to the edge 18 is defined sequentially by a guide rod 44 projecting horizontally from the side wall 38 parallel to the hub 36, and a horizontal upper surface of a platen 46 also projecting from the side wall 38, the end of which platen 46 opposite the rod 44 defines the edge 18. A second plate or shoe 48 also projects from the side wall 38 and has a lower surface closely spaced from the upper surface of the platen 46 to prevent the liner 14 and the labels 13 carried on it from arcing upwardly away from the upper surface of the platen 46 as the liner 14 is pulled around the edge 18, thereby helping to insure that the labels 13 will separate at the edge 18. The second path portion 20 for the liner 14 extending away from the edge 18 at an acute angle to the first path portion 19 is defined by a spool 50 projecting horizontally from the side wall 38 parallel to the edge 18 and hub 36, which spool 50 is rotatably mounted on the frame 16 and is driven by the motor 22 through a gear train (not shown) when the motor 22 is activated so that tension is caused in the liner 14 by wrapping it onto the spool 50 against the friction between the core 40 and the hub 36 and the rest of the path defining structures to provide the means for tensioning and pulling the liner 14 around the edge 18.

The support member 26 is elongate and is attached to the side wall 38 in a generally horizontal position by two bolts 52 projecting from the surface of the side wall 38 opposite the platen 46, which bolts 52 projecting through a horizontal slot 54 in the support member 26 and have manually loosenable and tightenable nuts 56 on their outer ends. The support member 26 can be adjusted relative to the frame 16 within limits determined by engagement of the bolts 52 with ends of the slot 54 so that its distal portion 28 carrying the photosensor 24 can be positioned at various spacings from the edge 18 to accommodate various sized labels 13. A guide shoe 57 is attached to the photosensor 24 and projects upwardly from the top of a slot in the photosensor 24 in which the end portion of a label 13 is sensed to insure that the end portion of the label 13 will be directed into that slot.

Figure 3:
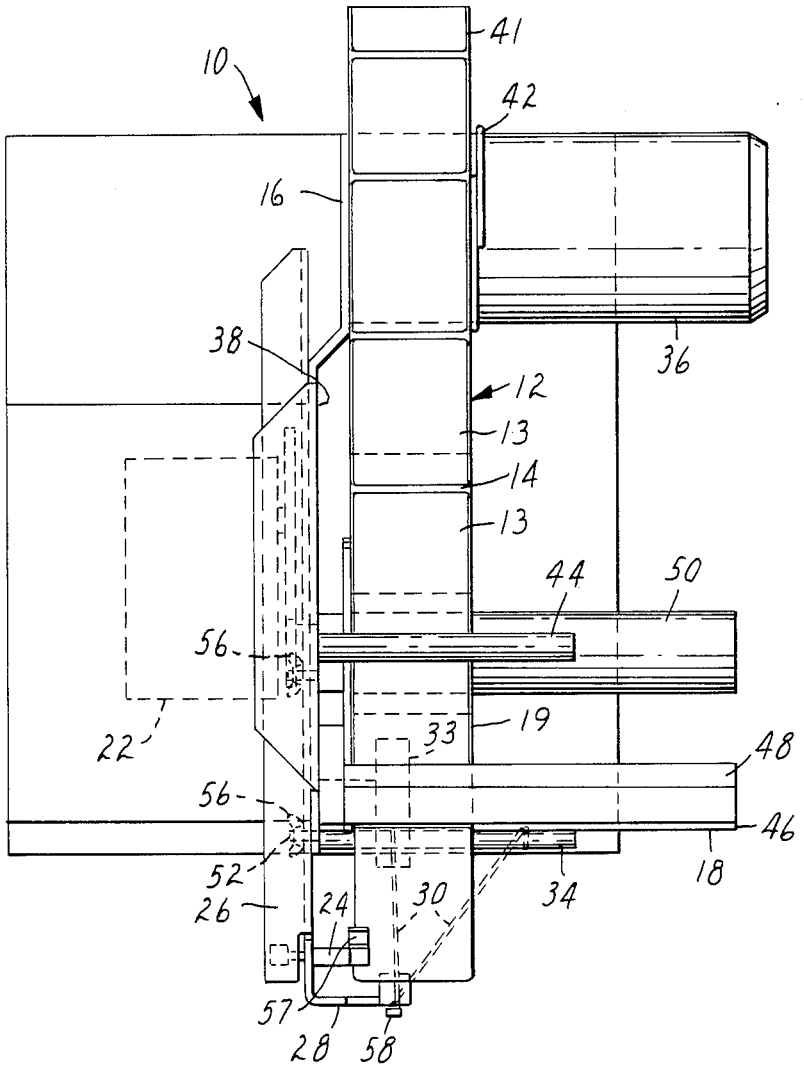
FIG. 3 is a top plan view of the device of FIG. 1.

As is shown in FIG. 3 only, the end of the guide member 30 can be released from the distal portion 28 of the support member 26 where it is normally held by a screw 58, wrapped around the screw 58 and have its end attached to the end of the guide rod 44. This is convenient for guiding wider labels 13, in that both lengths of the guide member 30 between the distal portion 28 and the guide rod 44 will help to guide and support a label 13 being dispensed.

To use the device 10, assuming a label 13 is positioned on the guide member 30 with its end portion in the photosensor 24, an operator removes the label 13 so that it can be attached to an object, whereupon the photosensor 24 through a control circuit activates the motor 22. The motor 22 rotates the spool 50, pulling the liner 14 along the path and around the edge 18 in a tensioned condition so that the next label 13 on the liner 14 separates at the edge 18 and continues past the edge 18 in the direction of the first path portion 19 of the liner 14 along the platen 46. The label 13 thus is driven along the slippery surface of the support member 26 until its end portion moves adjacent the photosensor 24, which then through the control circuit deactivates the motor 22, leaving the label 13 in a convenient position to be removed by the operator. If the operator should desire to dispense labels 13 of a different size, he can easily adjust the position of the distal portion 28 of the support member 26 by loosening the nuts 56 and sliding the support member 26 relative to the frame 16, whereupon the support member 26 will further extend from or be retracted into the reel 32 to accommodate the new position of the distal portion 24.

The present invention has now been explained with reference to one embodiment thereof. It will be apparent to those skilled in the art that many changes and modifications can be made to the embodiment described without departing from the spirit of the present invention. For example, the flexible guide member 30 may have a link chain or a spring metal strip (e.g., Negiator TM spring) as a core and may be coated with any slippery material that will not be adhered to by pressure sensitive adhesive, and various types of sensors other than photosensors may be used to sense an end portion of a label at the distal portion 28 of the support member 26. Thus the scope of the invention should not be limited by the structural details of the embodiment described herein, but only by the structures described by the dependent claims and the equivalents of those structures.

I claim:

1. In a device for dispensing labels from strip material comprising a plurality of labels releasably adhered seriatim along a release liner, said device being of the type including a frame, means on said frame adapted for defining a path for the release liner including an edge defining an abrupt change in direction about said edge between first and second path portions, means including a drive motor adapted for tensioning said release liner around said edge and pulling said release liner around said edge from said first path portion to said second path portion so that labels on said release liner will separate from the liner and continue past said edge in the direction of said first path portion to a position at which the labels may be manually engaged and removed for application to an object, and means for sensing the leading end portion of the labels separated from the liner at the edge and for stopping operation of said motor when the label end portion is sensed, the improvement wherein said device includes a support member having a distal portion supporting said means for sensing, said support member being adjustably mounted on said frame for movement to various positions with said distal portion at various spacings from said edge, and said device includes a flexible guide member between said distal portion and a position adjacent said edge, said flexible guide member having a surface adapted to afford sliding movement of the adhesive coated surface of said labels along said flexible guide member to guide the labels to said means for sensing, and means for varying the length of said flexible guide member upon movement of said support member to said various positions including a guide mounted on said frame at said position adjacent said edge with said flexible guide member fixed by said guide away from said edge.

2. A device according to claim 1 wherein said flexible guide member has one end attached to said distal portion and comprises a flexible metal core and a thin film coating on said core deposited from a plasma to provide said surface, and said means for varying the length of said flexible guide member includes a reel rotatably mounted on said frame with an end portion of said flexible guide member opposite said one end wrapped around said reel and means biasing said reel for rotation in a direction to wind said guide member around said guide and onto said reel.

3. A device according to claim 2 wherein said flexible metal core is link chain.

4. A device according to claim 2 wherein said flexible metal core is stranded cable.

5. A device according to claim 2 wherein said flexible metal core is a spring metal strip.

* * * * *

UNITED STATES PATENT AND TRADEMARK OFFICE

CERTIFICATE OF CORRECTION

PATENT NO. : 4,813,571

DATED : March 21, 1989

INVENTOR(S) : Michael G. Slagter

It is certified that error appears in the above-identified patent and that said Letters Patent is hereby corrected as shown below:

Col. 5, line 11, "fixed" should read --flexed--.

Signed and Sealed this

Twelfth Day of June, 1990

*Attest:*

HARRY F. MANBECK, JR.

*Attesting Officer*

*Commissioner of Patents and Trademarks*